US006568140B2

(12) United States Patent
Kirby

(10) Patent No.: US 6,568,140 B2
(45) Date of Patent: May 27, 2003

(54) APPARATUS AND METHOD FOR MAKING A SLOPED FLOOR

(76) Inventor: Mark E. Kirby, 2297 Jones Dr., Dunedin, FL (US) 34698

( * ) Notice: Subject to any disclaimer, the term of this patent is extended or adjusted under 35 U.S.C. 154(b) by 0 days.

(21) Appl. No.: 09/682,352

(22) Filed: Aug. 24, 2001

(65) Prior Publication Data

US 2003/0037497 A1 Feb. 27, 2003

(51) Int. Cl.[7] ..... E04F 21/00

(52) U.S. Cl. ..... 52/302.1; 52/741.41; 52/749.1; 4/613; 264/31; 264/35

(58) Field of Search ..... 52/749.1, 302.1, 52/741.41, 645; 4/613; 264/31, 35, 271.1

(56) References Cited

U.S. PATENT DOCUMENTS 5,140,789 A * 8/1992 De Gooyer ..... 52/71
5,845,347 A * 12/1998 Young ..... 4/613
6,088,984 A * 7/2000 Kirby ..... 52/302.1
6,155,015 A * 12/2000 Kirby ..... 52/302.1

* cited by examiner

*Primary Examiner*—Carl D. Friedman
*Assistant Examiner*—Jennifer I. Thissell
(74) *Attorney, Agent, or Firm*—Ronald E. Smith; Smith & Hopen, P.A

(57) ABSTRACT

An apparatus and method for making a sloped floor includes a plurality of elongate arms disposed in radial array relative to a drain. Each arm has a common height along its extent. The radially innermost end of each arm is positioned near or connected to the drain. In a first embodiment, the radially innermost end of each arm is pivotally connected to an adapter that is connected to a center ring that circumscribes the drain. In a second embodiment, each arm is positioned at an incline by an adapter that rigidly joins the arm to the center ring. In a third embodiment, the arms are of shallow construction and are removed after the concrete has been poured. A mounting strip secured to the shower wall may support the radially outermost end of each arm. In all embodiments, the concrete is worked so that it is flush with the uppermost edge of each elongate arm.

20 Claims, 11 Drawing Sheets

APPARATUS AND METHOD FOR MAKING A SLOPED FLOOR

BACKGROUND OF INVENTION

1. Field of the Invention

This invention relates, generally, to the construction arts. More particularly, it relates to an apparatus and method for making a sloped floor such as a shower floor.

2. Description of the Prior Art

U.S. Pat. Nos. 6,088,984 and 6,155,015 to the present inventor represent the prior art most relevant to the present invention. Those patents disclose apparatus and methods, respectively, for making a sloped floor, such as a shower floor, by positioning a plurality of elongate arms in radial array about a center ring that circumscribes a shower drain. Each arm has a flat bottom edge that rests atop a pitched or unpitched floor surface. Each arm has a sloped upper edge that determines the slope of the shower floor when the installation is completed. The height of each arm is relatively low at its radially innermost end where it connects to the center ring and is relatively higher at its radially outermost end where it abuts the vertical walls of the shower stall. Thus, when concrete is poured into the shower stall and screed so that it is flush with the uppermost edges of the arms, the resulting slope is predetermined by the arms. This eliminates the need to form the slope by more involved methods and enables an unlimited number of shower floors to be constructed with a common ideal slope.

The earlier system works well and has no substantial shortcomings.

Accordingly, in view of the prior art considered as a whole at the time the present invention was made, it was not obvious to those of ordinary skill in the pertinent art how further innovations could be provided.

SUMMARY OF INVENTION

The new, useful, and nonobvious invention of this disclosure enables the construction of a sloped floor with elongate arms that have a common height throughout their extent. The radially innermost end of each elongate arm may be attached to any part of a drain structure or to a center ring that circumscribes a drain. In a first embodiment, the slope of each elongate arm is adjustable by turning a setscrew positioned near a radially innermost end of the arm. In a second embodiment, a clip having a predetermined angular orientation is secured to a center ring and the radially innermost end of each arm is secured to the clip. The clip holds the arm so that the radially outermost end of the arm is elevated with respect to its radially innermost end, with the angle of slope being determined by the structure of the clip. In a third embodiment, each arm has a shallow construction so that it is removable from the cement after the floor has been poured. In a fourth embodiment, the radially outermost ends of the arms are secured to a fastening means that circumscribes the shower stall.

A primary object of the invention is to provide a method and apparatus for facilitating the installation of a sloped floor such as a shower floor.

Another closely related object is to enable such installation using elongate arms of uniform height.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
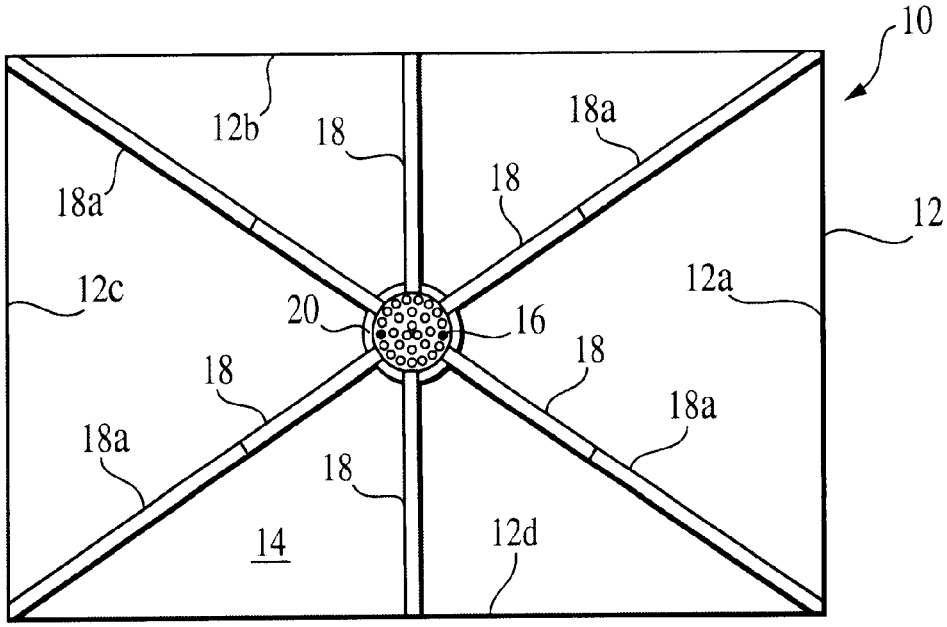
FIG. 1 PRIOR ART
FIG. 1 is a top plan view of a shower floor depicting the elongate arms having their respective radially innermost ends connected to a center ring that circumscribes a drain.

Referring to FIG. 1, it will there be seen that the reference numeral 10 denotes an illustrative embodiment of the present invention installed in a shower stall 12 or other room having a floor 14 that slopes to a drain 16.

A plurality of arms 18 of elongate construction is depicted in radial array relative to drain 16. The radially innermost end of each arm 18 is positioned contiguous to drain 16 but need not be attached thereto. However, unwanted movement of said arms can be prevented by securing the radially innermost ends to a part of the drain. For example, said radially innermost ends may be secured to the body of the drain, the frame, the riser, the strainer, or any other related part of the drain.

In the preferred embodiment of this invention, the radially innermost ends are secured to center ring 20. Said center ring 20 is positioned in circumscribing relation to drain 16, preferably in concentric relation therewith.

Figure 2:
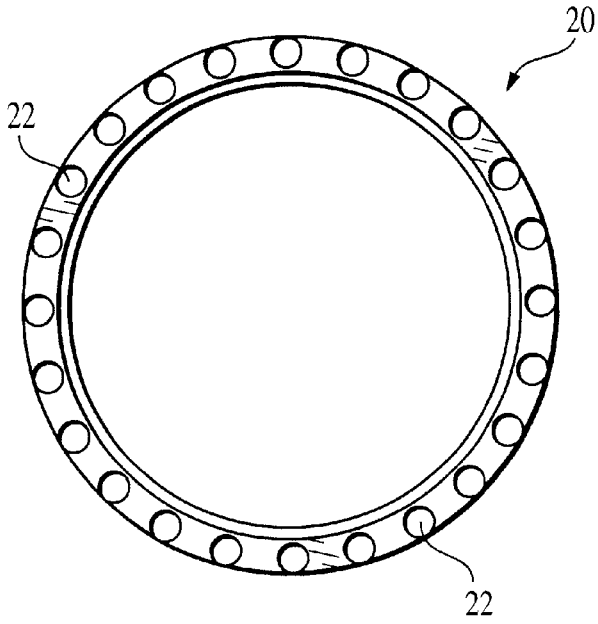
FIG. 2 is a top plan view of a first embodiment of a center ring.
Figure 3:
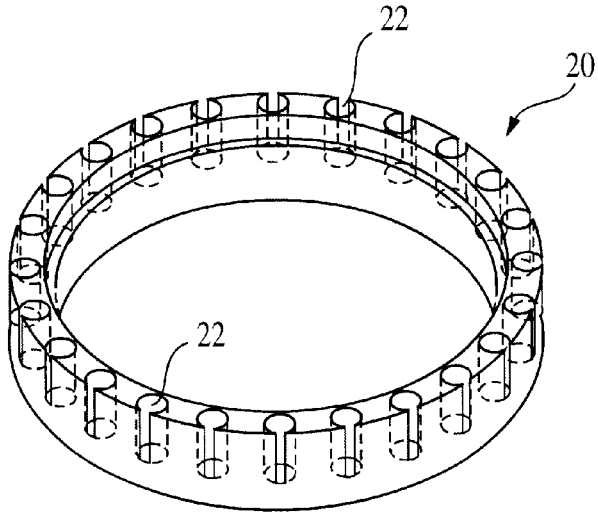
FIG. 3 is a perspective view of the center ring depicted in FIG. 2.

FIG. 2 depicts center ring 20 in plan view and FIG. 3 provides a perspective view thereof. A plurality of blind cylindrical bores, collectively denoted 22, is formed in center ring 20 in circumferentially and equidistantly spaced relation to one another. Each blind bore has a radially outermost section in open communication with the outer peripheral edge of center ring 20 as perhaps best understood in connection with FIG. 3.

Figure 4:
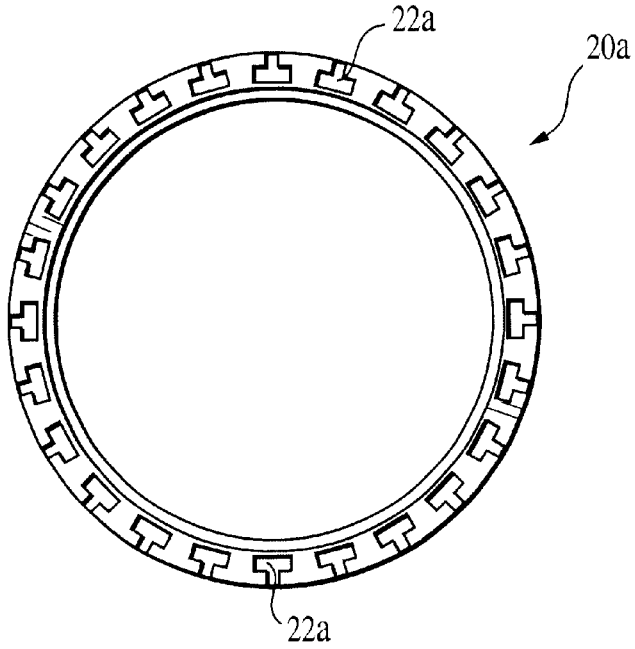
FIG. 4 is a top plan view of a second embodiment of the center ring.
Figure 5:
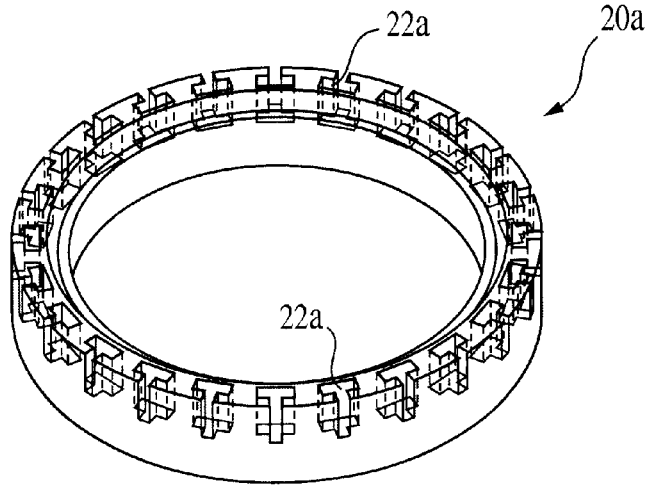
FIG. 5 is a perspective view of the center ring depicted in FIG. 4.

An alternative embodiment 20*a* of center ring 20 is depicted in FIGS. 4 and 5. The blind bores 22*a* of this embodiment are also circumferentially and equidistantly spaced apart from one another, but instead of having a cylindrical cross-section, their respective cross-sections have a generally "T"-shaped configuration. The base of each bore is in open communication with the outer peripheral edge of center ring 20*a*.

Figure 6:
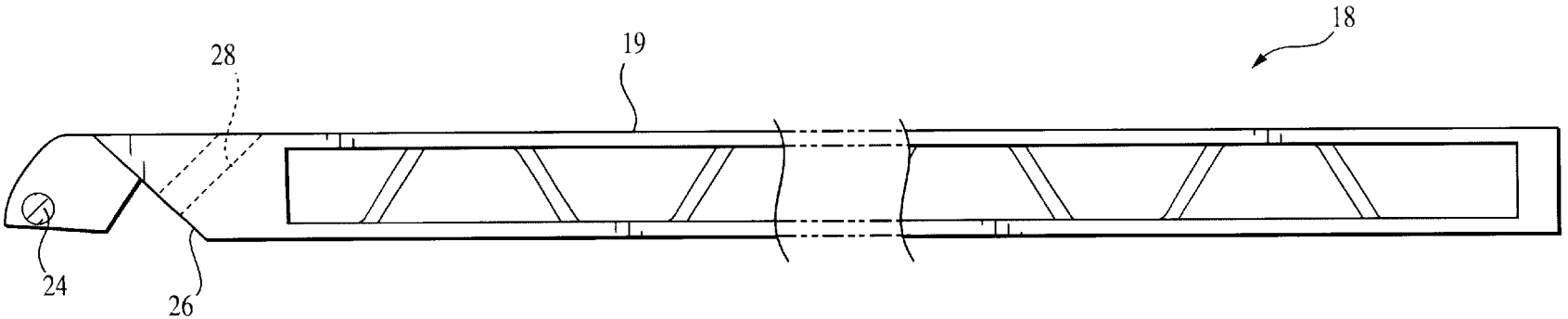
FIG. 6 is a side elevational view of a first embodiment of an elongate arm of uniform height along its extent.

A side elevational view of an arm 18 is provided in FIG. 6. In this embodiment, an unnumbered truss-like structure provides the needed strength while saving materials and reducing the weight of the arm. The upper edge of arm 18 is denoted 19. When concrete is poured to complete the sloped floor, it is made flush with upper edge 19. Thus, the rest of arm 18 is permanently embedded in the concrete.

Figure 7:
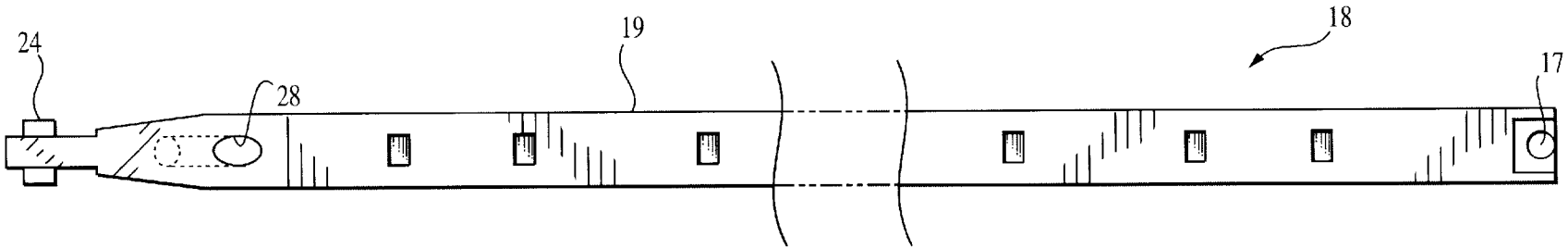
FIG. 7 is a top plan view of the arm depicted in FIG. 6.
Figure 10:
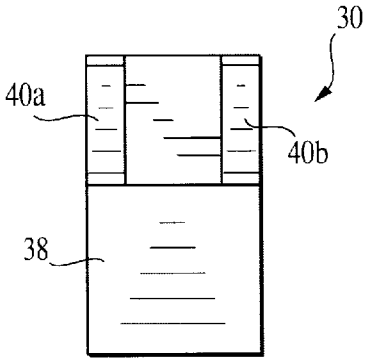
FIG. 10 is a front end view of the means of FIG. 8.

As perhaps best understood in connection with FIG. 7, a transversely disposed peg or pivot pin 24 is formed in the leading end of arm 18. As best indicated in FIG. 6, beveled surface 26 is formed in said arm just to the rear of said pivot pin. Cylindrical throughbore 28 has a lowermost or leading end in open communication with beveled surface 26 and the longitudinal axis of the throughbore is perpendicular to said beveled surface 26.

It should also be noted at the right hand end of FIGS. 6 and 7 that the trailing end of arm 18 is adapted to engage the leading end of an auxiliary arm 18*a* (FIG. 1) of similar construction to thereby effectively lengthen arm 18 in those applications requiring arms of greater extent. FIG. 1 depicts auxiliary arms 18*a* having their respective leading ends releasably engaged to the respective trailing ends of arms 18.

Connector 30, depicted in FIGS. 8–11, interconnects the leading or radially innermost end of an arm 18 to center ring 20. There is a plurality of said connectors connected to center ring 20 in circumferentially spaced relation to one another. Each connector 30 has a radially innermost part 32 that fully occupies an associated blind bore 22 of center ring 20 when the novel apparatus is assembled. The cylindrical cross-section of said part 32 is depicted in the plan view of FIG. 9. The opposite ends of pivot pin 24 (FIGS. 6 and 7) are pivotally supported in the respective rounded bottoms 32*a*, 32*b* of vertical slots 34*a*, 34*b*, formed in upstanding sidewalls 36*a*, 36*b* of connector 30 when the leading (radially innermost) end of arm 18 is positioned in sandwiched relation between said upstanding sidewalls 36*a*, 36*b*.

Figure 11:
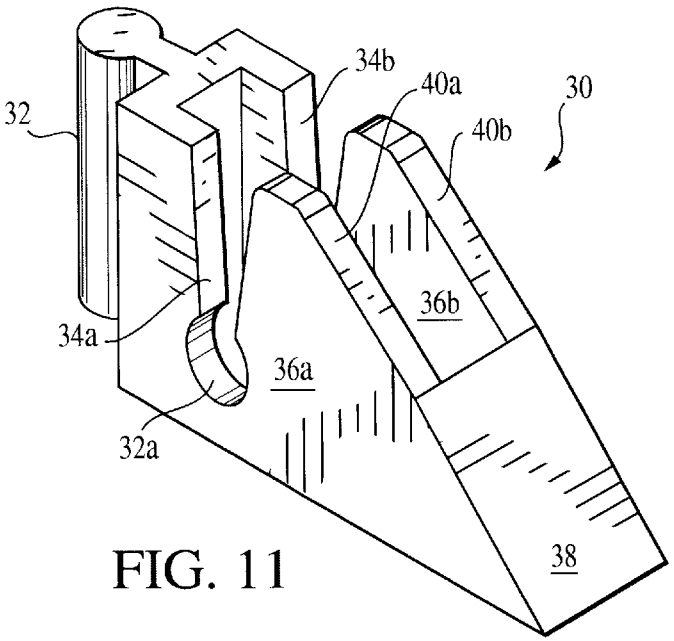
FIG. 11 is a perspective view of the means of FIG. 8.
Figure 8:
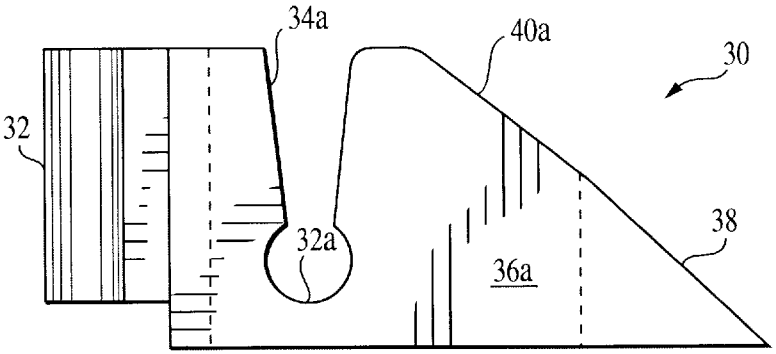
FIG. 8 is a side elevational view of a means for pivotally interconnecting an elongate arm to the center ring.
Figure 9:
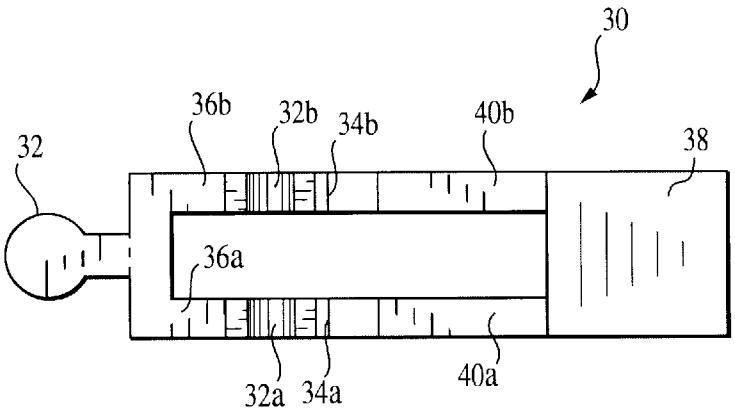
FIG. 9 is a top plan view of the means of FIG. 8.

An imperforate bearing wall 38 interconnects sidewalls 36*a*, 36*b*, as perhaps best understood in connection with FIGS. 9 and 11.

Figure 12:
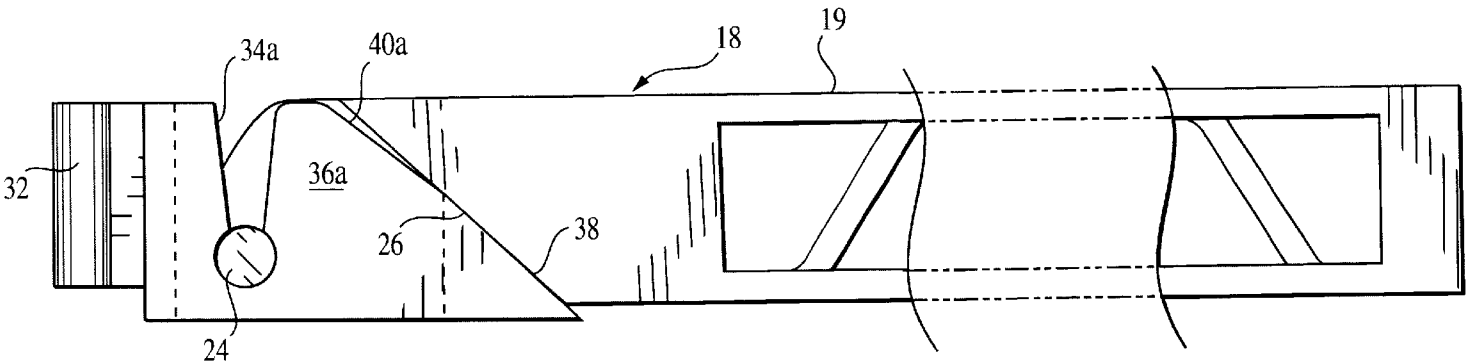
FIG. 12 is a side elevational view of the arm of FIGS. 6 and 7 disposed in interconnected relation to the means of FIGS. 8–11 when said arm is in a horizontal disposition.
Figure 13:
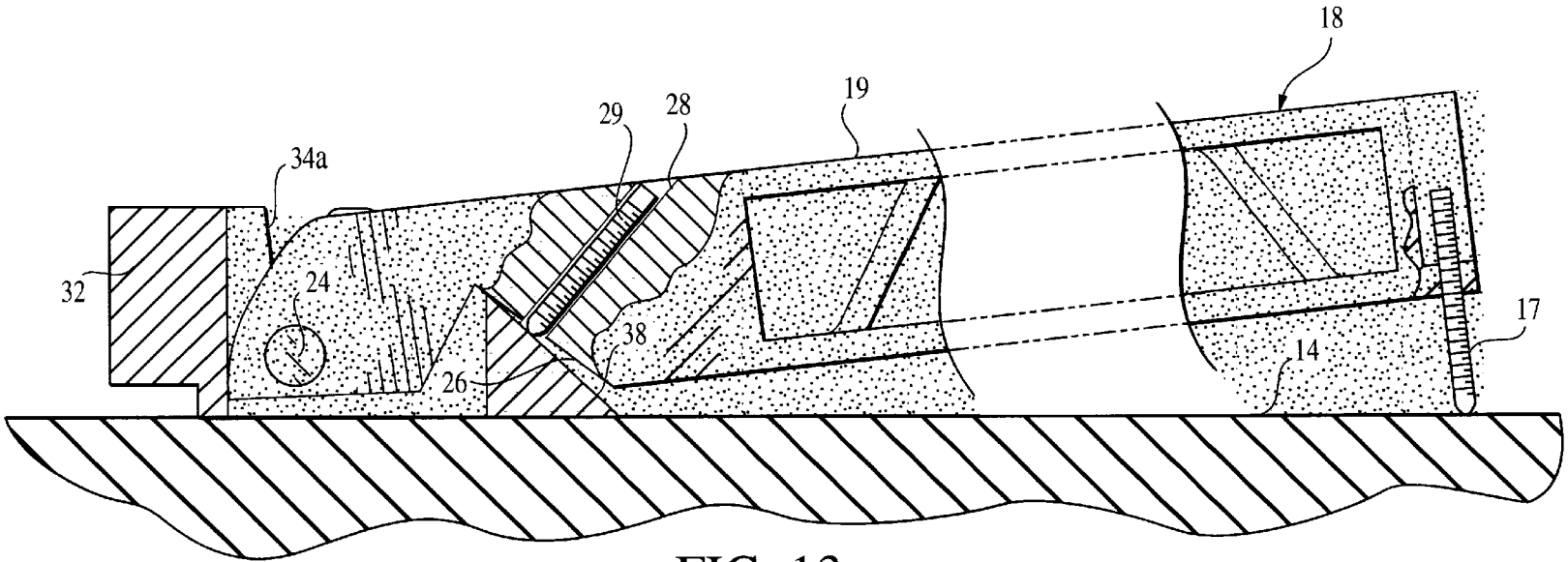
FIG. 13 is a side elevational view of the arm of FIGS. 6 and 7 disposed in interconnected relation to the means of FIGS. 8–11 when said arm is in a sloped disposition.

As best understood in connection with FIGS. 12 and 13, beveled surface 26 (FIG. 6) of arm 18 overlies bearing wall 38 when arm 18 is in repose. Note that an unnumbered gap exists between beveled surfaces 40*a*, 40*b* and beveled surface 26 when said arm 18 is in repose. The slopes of the mating beveled surfaces are preselected so that arm 18 is sloped toward the center ring or drain at a quarter inch per foot when said arm is in said position of repose. Accordingly, if concrete were poured into the shower area and screed to the level of upper edge 19, the resulting floor would have a quarter inch per foot slope. However, there is no requirement that this minimum slope be built in. It is also within the scope of this invention to form the mating beveled surfaces so that arm 18 is horizontal when in repose. The user would then be required to slope the arm in the manner hereinafter to be described. Even if a quarter inch slope is built in, the following steps are required to increase the slope if desired.

To impart additional slope to arm 18 and hence to upper edge 19 thereof, setscrew 29 is advanced in setscrew bore 28 so that its leading end bears against bearing wall 38. The unnumbered gap appearing in FIG. 12 decreases in size and disappears as setscrew 29 is advanced further and further until said setscrew is fully advanced as depicted in FIG. 13. Simultaneously, an unnumbered gap appears between beveled surface 26 of arm 18 and bearing surface 38 of connector 30. The radially innermost end of arm 18 is now disposed between upstanding beveled surfaces 40*a*, 40*b* formed in sidewalls 36*a*, 36*b*. This imparts a maximum slope to arm 18 and hence upper edge 19 thereof. Thus, any intermediate degree of slope is attained by advancing the setscrew an appropriate distance between its unadvanced and fully advanced positions, there being an infinite plurality of functional positions of adjustment between the in-repose position of FIG. 12 and the fully inclined position of FIG. 13.

An optional auxiliary screw 17 is screw threadedly, slidingly, or otherwise adjustably engaged in a bore formed in a radially outermost end of arm 18 as depicted in FIG. 13. However, screw 17 could also be positioned radially inwardly relative to said radially outermost end and still perform the same function. Screw 17 supports said radially outermost end, but it may be eliminated from the novel apparatus without significant detriment to the system.

Figure 14:
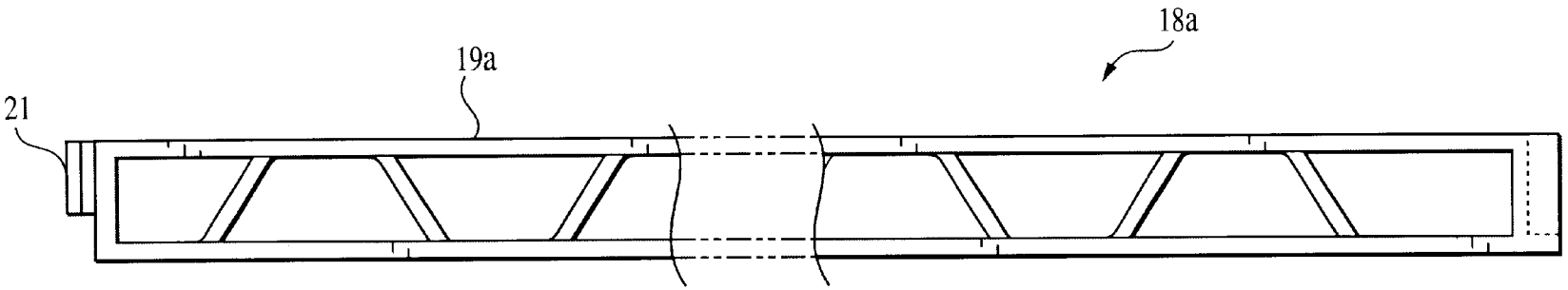
FIG. 14 is a side elevational view of a second embodiment of the elongate arm.
Figure 15:
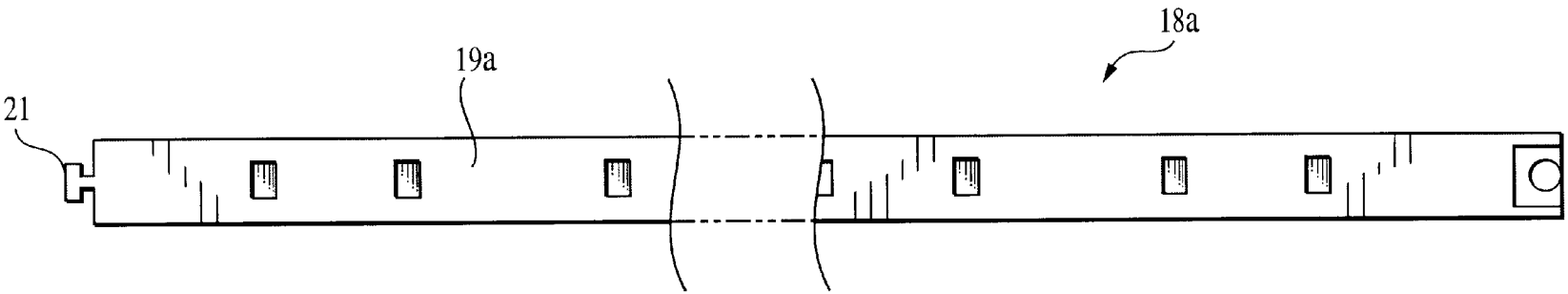
FIG. 15 is a top plan view of the arm depicted in FIG. 14.
Figure 19:
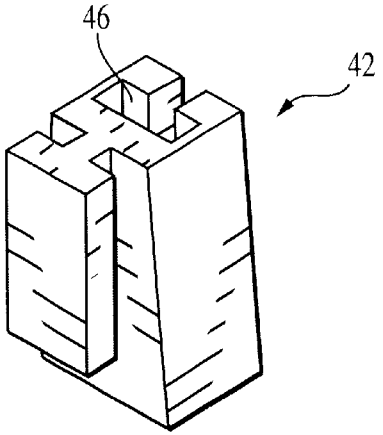
FIG. 19 is a perspective view of the means depicted in FIGS. 16–18.
Figure 18:
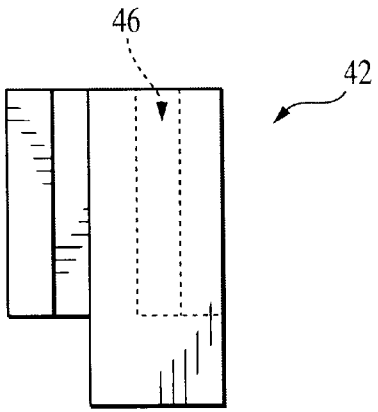
FIG. 18 is a side elevational view of the means depicted in FIG. 16.
Figure 16:
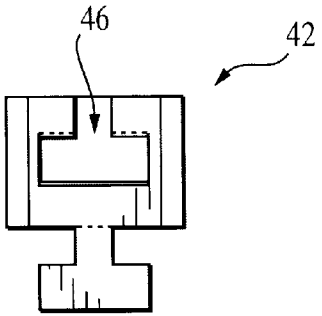
FIG. 16 is a top plan view of a means for interconnecting the radially innermost end of an elongate arm to the center ring of FIGS. 4 and 5.
Figure 17:
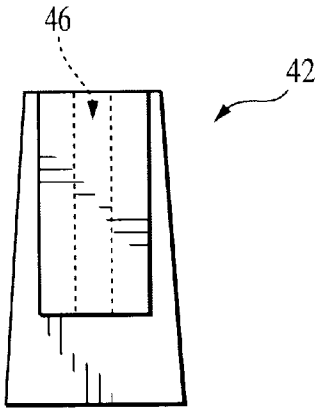
FIG. 17 is a front end view of the means depicted in FIG. 16.

A second embodiment of elongate arm 18, denoted 18*a* in FIGS. 14 and 15, is adapted at its radially innermost end to engage connector 42 of FIGS. 16–19. Specifically, a "T"-shaped connector 21 is formed in said radially innermost end. Connector 42 has a "T"-shaped radially innermost part 44 that engages an associated "T"-shaped bore 22*a* formed in center ring 20*a* of FIGS. 4 and 5. Connector 42 further includes a "T"-shaped bore 46 formed in its radially outermost end. Bore 46 slidingly receives "T"-shaped connector 21 formed in the radially innermost end of arm 18*a*. Significantly, a slope is imparted to arm 18*a* because bore 46 is canted relative to a vertical plane at a predetermined angle that is hard to see in the Figure but which should be understood as being present.

Figure 20:
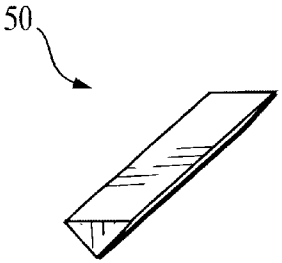
FIG. 20 is a perspective view of a third embodiment of the elongate arm.

Rod 50 of FIG. 20 has a triangular cross-section. It may be formed of aluminum, stainless steel, plastic, metal-containing plastic, or other suitably stiff and durable material.

Figure 21:
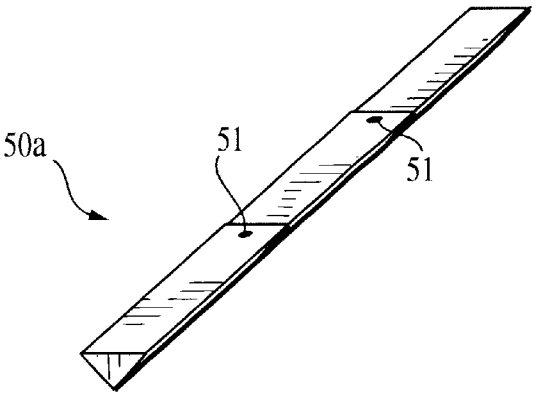
FIG. 21 is a perspective view of a telescopically constructed version of the elongate arm of FIG. 20.

As indicated in FIG. 21, rod 50*a* may have a telescopic construction. Thus, in an application where rod 50 has insufficient length, rod 50*a* is advantageously used. The user merely extends rod 50*a* to the desired extent and tightens setscrews 51 to maintain the proper length when said proper length has been found.

Unlike arms 18 and 18*a*, rod 50 or 50*a* has a very shallow construction. In a preferred embodiment, the uniform height of rod 50 or 50*a* is about one-quarter inch. Thus, when concrete is poured and worked until it is flush with the flat top wall of arm 50 or 50*a*, it is easy to retrieve said arm so that it is not embedded in the floor. A shallow "V"-shaped groove remains in the floor, but such groove is filled if needed and covered by tile when the installation is complete.

The radially innermost end of rod 50 or 50*a*, like arms 18 and 18*a*, may be attached to a center ring such as center ring 20, for example, or it may be attacked to a preselected part of drain 16, or it may be positioned near said drain but not attached thereto.

Figure 22:
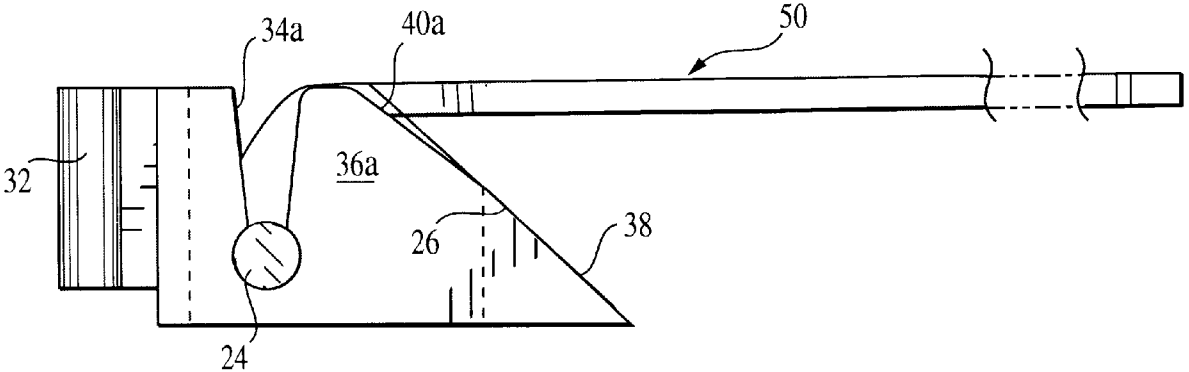
FIG. 22 is a side elevational view depicting the elongate arm of FIGS. 20 or 21 adapted for pivotal connection to the connector of FIGS. 8–11.

As indicated in FIG. 22, rod 50 or 50*a* may be connected to center ring 20 by the same coupler 30 depicted in FIGS. 8–11. Alternatively, many different types of couplers could be used to pivotally attach the radially innermost end of rod 50 or 50*a* to said center ring.

Figure 23:
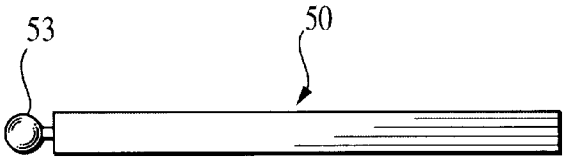
FIG. 23 is a plan view of an embodiment of the elongate arm having a bulbous radially innermost end.

However, the desired pivotal connection may also be made in the absence of a coupler because the radially innermost end of rod 50 or 50*a* could be directly pivotally coupled to said center ring. For example, a bulbous means 53 is formed on the radially innermost end of a rod 50 or 50*a* as depicted in FIG. 23. Bulbous means 53 forms a ball suitable for connection to a socket of the type formed in center ring 20 of FIGS. 2 and 3. Numerous ways could then be provided to impart a slope as desired to such rod. Any height-adjustment means, such as but not limited to screw 17 of FIG. 13, could be employed, for example. A ratchet and pawl mechanism could be provided as well, as a part of the ball and socket interconnection, so that the slope could be adjusted simply by lifting the radially outermost end of the rod. An adjustable height means could be employed in conjunction with such a ratchet and pawl arrangement.

Figure 24:
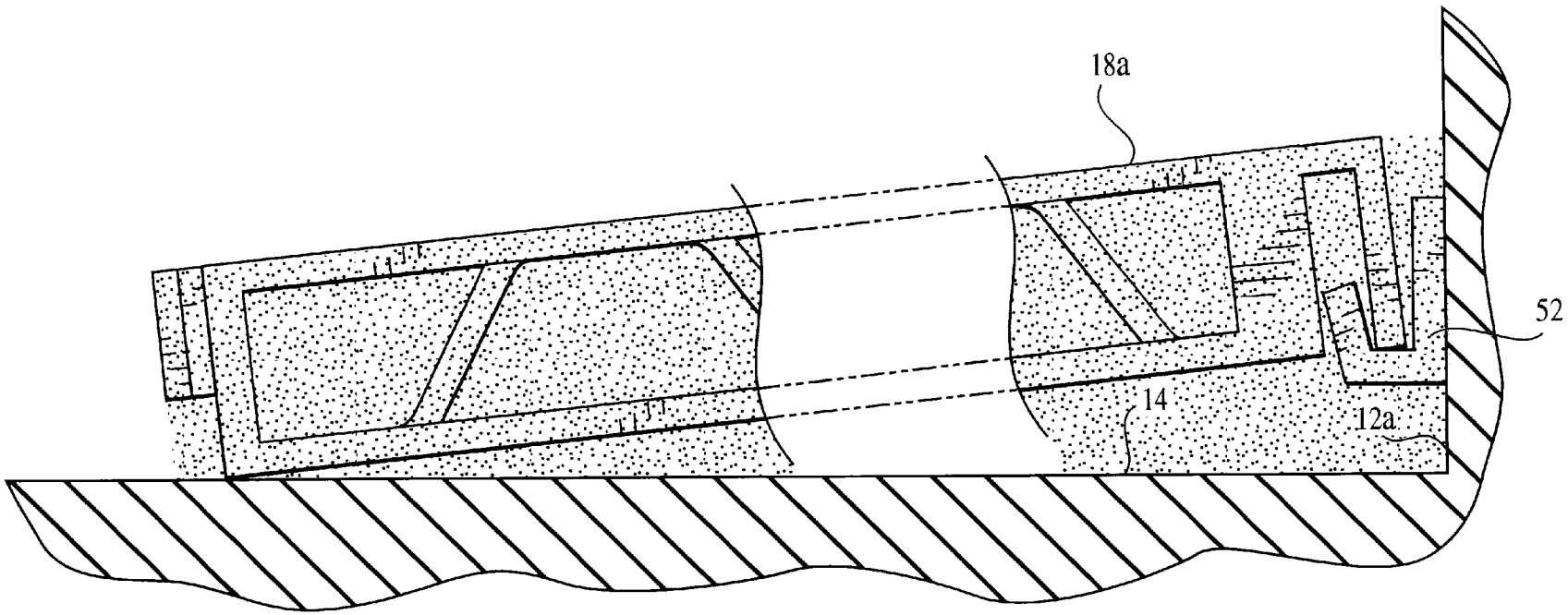
FIG. 24 is a side elevational view depicting an alternative means for elevating a radially outward end of an elongate arm.
Figure 26:
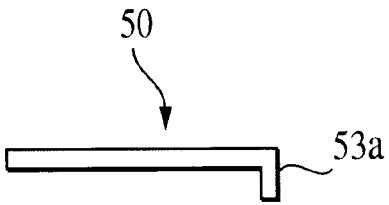
FIG. 26 is a side elevational view of an elongate arm adapted to engage the center ring of FIG. 25.

The radially outermost end of arm 18, 18*a*, or rod 50, 50*a* may also be advantageously secured to a mounting means secured to the shower wall that is elevated with respect to the drain by a predetermined amount. As depicted in FIG. 24, mounting means 52 is preferably provided in the form of a bracket or strip of material that is mountable by suitable means to shower walls 12*a*, 12*b*, 12*c*, and 12*d* (FIG. 1). It may have a channel or "J" shape as depicted, or any other functional shape. Thus, the radially outermost end of an arm 18, 18*a*, or rod 50, 50*a* is easily secured to said strip 52 and the desired slope is thereby established. The installer must position bracket 52 at a proper elevation relative to shower floor 14 to achieve the desired angle of slope.

In the alternative, the radially outermost end of arms 18, 18*a*, or rods 50, 50*a*, may be supported by adjustable height means such as screw 17 in FIG. 13 or mounting strip 52 in FIG. 24. Said radially outermost ends may also be unsupported. In such event, the arm or rod is supported at a preselected slope by the means for coupling the arm or rod to the center ring or the drain.

Neither arms 18, 18*a*, nor rod 50, 50*a* has the tapered construction of the arms of the prior art. Such arms and rods are thus easier and less expensive to manufacture than the tapered arms. Moreover, the means disclosed herein for positioning said arms and rods at various predetermined angles to create sloped floors further advances the construction arts in a substantial way.

Figure 25:
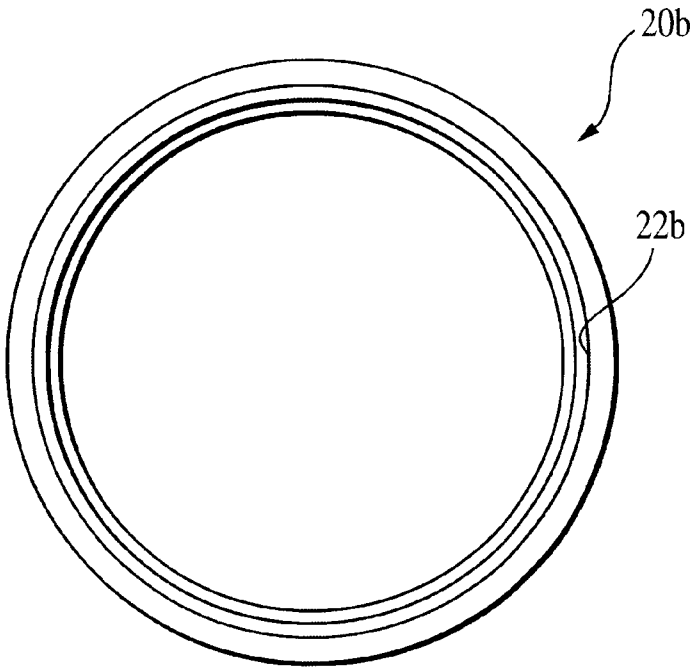
FIG. 25 is a top plan view of a third embodiment of the center ring.

A circular slot 22*b* is formed in center ring 20*b* of FIG. 25 in substantially concentric relation therewith. Slot 22*b* is slideably engageable by any of the elongate arms of this invention, not just elongate arm 50 as depicted. Any suitable engagement means such as elbow 53*a* may be employed. Elbow 53*a* may be hingedly mounted to an elongate arm so that the angle between said elongate arm and said elbow is adjustable to any degree of slope that may be required to complete a sloped floor in accordance with the teachings of this invention. As in the earlier-described embodiments, all other means for changing the angle between such elbow and the elongate arm are within the scope of this invention, including ratchet and pawl mechanisms, setscrews, couplers such as those depicted in FIGS. 16–19, means for holding the radially outermost end of the elongate arm at a predetermined elevation such as depicted in FIG. 24, and so on. Moreover, any attachment means that is slideably disposed within circular slot 22*b* is within the scope of this invention, not just elbow 53*a*.

Advantageously, circular slot 22*b* enables elongate arms such as 18, 18*a*, 50, 50*a* to be positioned in infinitely many functional angles of radial adjustment relative to center ring 20*b*. Moreover, the cementitious material used to complete the sloped floor cannot enter into slot 22*b*; note that such material can enter into openings 22 of center ring 20 and openings 22*a* of center ring 22 because such openings are in open communication with the exterior surface of center rings 20, 22. Thus, if a center ring is re-used, openings 22 or 22*a* must be cleaned out prior to re-use. No such cleaning is required when center ring 20*b* is used.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An apparatus for making a floor that slopes toward a drain means, said drain means projecting upwardly from a floor, comprising:

a plurality of arms of elongate construction;

each arm of said plurality of arms having a uniform height along its length;

said plurality of arms adapted to be disposed in radial array relative to said drain means;

an innermost end of each arm of said plurality of arms being disposed at a common first height; and an outermost end of each arm of said plurality of arms being disposed at a common second height that is greater than said common first height;

whereby a sloped floor is constructed by pouring a concrete means onto said floor and working said concrete means so that it is flush with an uppermost edge of said arms.

2. The apparatus of claim 1, further comprising:

each arm having a transversely disposed pivot pin formed in its radially innermost end.

3. The apparatus of claim 1, further comprising:

each arm having a radially outermost end adapted to be engaged by a radially innermost end of another arm of similar construction.

4. The apparatus of claim 2, further comprising:

a center ring that encircles said drain means;

a plurality of connector means that engage said center ring about the periphery thereof in circumferentially spaced relation to one another;

each connector means adapted to pivotally engage an arm associated therewith.

5. The apparatus of claim 4, wherein each connector means includes a radially innermost part that engages said center ring and a main part adapted to pivotally engage a radially innermost end of said arm associated therewith.

6. The apparatus of claim 5, wherein said main part includes a pair of upstanding, opposed parallel sidewalls, each of said sidewalls having a vertically-extending slot formed therein, each of said slots having a rounded bottom part and each of said rounded bottom parts pivotally receiving an end of said transversely disposed pivot pin.

7. The apparatus of claim 6, further comprising:

a beveled surface formed in each sidewall of said main part, radially outwardly of said transversely disposed pin;

a beveled bearing wall that interconnects said sidewalls;

said beveled surface disposed in overlying relation to said beveled bearing wall when said arm is substantially horizontally disposed;

a throughbore formed in said arm, said throughbore having an axis of symmetry substantially perpendicular to said beveled surface and said bearing wall; and a setscrew screwthreadedly received in said throughbore so that advancing said setscrew causes said transversely disposed pivot pin to pivot in said rounded bottom part, thereby causing a radially outwardly end of said arm to elevate with respect to said radially inner end of said arm.

8. The apparatus of claim 1, further comprising a height-adjustment means carried in each of said arms at a preselected location radially outward of the innermost end of each of said arms.

9. The apparatus of claim 8, wherein said height-adjustment means is a screw adapted to increase said second height when advanced and adapted to reduce said second height when retracted.

10. An apparatus br making a floor that slopes toward a drain means, said drain means projecting upwardly from a floor, comprising:

a plurality of arms of elongate construction;

each arm of said plurality of arms having a uniform height along its length;

said plurality of arms adapted to be disposed in radial array relative to said drain means;

an innermost end of each arm of said plurality of arms being disposed at a common first height;

an outermost end of each arm of said plurality of arms being disposed at a common second height that is greater than said common first height;

a center ring positioned in circumscribing relation to said drain means;

a plurality of connectors, each connector having a radially innermost end connected to said center ring;

each connector having a radially outermost end adapted to engage a radially innermost end of an associated arm;

said radially outermost end of each connector being inclined by a predetermined degree so that said arm connected thereto is inclined at a predetermined inclination;

whereby each of said arms is held in an inclined position by its associated connector;

whereby a sloped floor is constructed by pouring a concrete means onto said floor and working said concrete means so that it is flush with an uppermost edge of said inclined arms.

11. An apparatus for making a floor that slopes toward a drain means, said drain means projecting upwardly from a floor, comprising:

a plurality of arms of elongate construction;

each arm of said plurality of arms having a uniform height along its length;

said uniform height being about one-quarter inch;

each of said arms having a triangular cross-section;

said plurality of arms adapted to be disposed in radial array relative to said drain means;

an innermost end of each arm of said plurality of arms being disposed at a common first height;

an outermost end of each arm of said plurality of arms being disposed at a common second height that is greater than said common first height;

whereby a sloped floor is constructed by pouring a concrete means onto said floor and working said concrete means so that it is flush with an uppermost edge of said inclined arms;

whereby said arms are removed from said concrete means after said concrete means has been poured.

12. A method of installing a sloped floor, comprising the steps of:

providing a plurality of arms of elongate construction;

configuring each arm of said plurality of arms to have a uniform height of about one-quarter inch along its length;

positioning said plurality of arms in radial array relative to a drain means;

positioning an innermost end of each arm of said plurality of arms at a common first height;

positioning an outermost end of each arm of said plurality of arms at a common second height that is greater than said common first height;

pouring a concrete means onto a floor and working said concrete means so that it is flush with an uppermost edge of each of said arms; and removing each arm of said plurality of arms after said concrete means has been poured and worked.

13. The method of claim 12, further comprising the step of configuring each arm to have a triangular cross-section.

14. The method of claim 13, further comprising the step of configuring each arm of triangular cross-section to have a telescoping construction so that its length can be extended to fit spaces of differing sizes.

15. The method of claim 14, further comprising the step of providing a locking means to lock a telescoped arm into a preselected position of adjustment.

16. The apparatus of claim 1, further comprising:

a mounting strip adapted to be fastened to an upstanding wall that encloses said floor;

said mounting strip being positioned in predetermined spaced relation to said floor;

each of said arms having a fastener means, formed in said outermost end thereof, for engaging said mounting strip;

whereby an innermost end of each arm is positioned adjacent said drain means and an outermost end of each arm is secured to said strip means;

whereby a slope for each arm is determined by the spacing of said mounting strip from said floor.

17. The apparatus of claim 11, further comprising height-adjustment means for adjusting the height of said outermost ends of said arms.

18. The apparatus of claim 17, wherein said height-adjustment means includes a screw carried in each of said arms at a preselected location radially outward of the innermost end of each of said arms, said screw adapted to increase said second height when advanced and adapted to reduce said second height when retracted.

19. The apparatus of claim 1, further comprising:

a center ring disposed in substantially concentric relation to said drain means;

a circular slot formed in said center ring in substantially concentric relation thereto;

each arm of said plurality of arms adapted to slidingly engage said circular slot;

whereby each arm is infinitely adjustable so that it may extend from said center ring in any radial position.

20. The apparatus of claim 19, further comprising means for adjusting the height of the radially outermost end of each arm of said plurality of arms.

* * * * *